United States Patent [19]

Heitmann et al.

[11] Patent Number: 4,924,885

[45] Date of Patent: May 15, 1990

[54] METHOD OF AND APPARATUS FOR BUILDING, GUIDING AND TRIMMING STREAMS OF FIBROUS MATERIAL

[75] Inventors: Uwe Heitmann; Peter Brand, both of Hamburg, Fed. Rep. of Germany

[73] Assignee: Körber AG, Hamburg, Fed. Rep. of Germany

[21] Appl. No.: 272,070

[22] Filed: Nov. 16, 1988

[30] Foreign Application Priority Data

Nov. 25, 1987 [JP] Japan ..... 62-3739874

[51] Int. Cl.[5] ..... A24C 15/18

[52] U.S. Cl. ..... 131/84.4

[58] Field of Search ..... 131/84.1, 84.2, 84.3, 131/84.4

[56] References Cited

U.S. PATENT DOCUMENTS 4,485,826 12/1984 Holzangel ..... 131/84.4

4,600,020 7/1986 Mattei et al. ..... 131/84.4

*Primary Examiner*—V. Millin

*Attorney, Agent, or Firm*—Peter K. Kontler

[57] ABSTRACT

Belt conveyors which advance two or more discrete streams of fibrous material past discrete surplus removing equalizing devices are guided in such a way that the portions of streams which are in the process of being trimmed are spaced apart from each other stream. This renders it possible to employ reliable equalizing devices having pairs of coplanar rotary trimming discs. The conveyors are guided by pulleys and/or their marginal portions extend into grooves which are provided in the sidewalls of channels for the streams of fibrous material. The equalizing devices are staggered with respect to each other in the direction of transport of the streams.

16 Claims, 2 Drawing Sheets

METHOD OF AND APPARATUS FOR BUILDING, GUIDING AND TRIMMING STREAMS OF FIBROUS MATERIAL

BACKGROUND OF THE INVENTION

The invention relates to improvements in methods of and in apparatus for building and manipulating plural streams of fibrous material, such as tobacco. More particularly, the invention relates to improvements in methods of and in apparatus for building, guiding and trimming two or more streams each of which can be converted into a rod-like filler, e.g., into a filler of the type suitable for draping into a web of cigarette paper or other wrapping material to form with the web a continuous rod which is ready to be subdivided into rod-like sections (e.g., plain cigarettes) of unit length or multiple unit length.

It is known to deliver fibrous material (such as fragments of tobacco leaf laminae, tobacco ribs, reconstituted tobacco and/or substitute tobacco) to a stream building zone wherein the delivered fibrous material is converted into a plurality of discrete streams each of which is advanced by a discrete conveyor and each of which normally contains a surplus of fibrous material. The surplus must be removed by suitable trimming or equalizing devices in order to convert each stream into a rod-like filler which is ready for condensing, wrapping and subdivision into discrete rod-like sections of desired length. The machine is equipped with means for removing the surplus from the discrete streams so as to convert each stream into a rod-like filler which is ready for condensing and wrapping prior to advancing to a cutoff wherein the wrapped filler is subdivided into a file of discrete rod-shaped articles. Heretofore known machines of the just outlined character exhibit the drawback that the removal of surplus from the stream necessitates the utilization of complex, sensitive and expensive trimming or equalizing devices. This is attributable, at least in part, to the fact that all heretofore known machines for simultaneous building and processing of two or more streams of fibrous material are equipped with conveyors which advance the streams along closely adjacent parallel paths.

OBJECTS OF THE INVENTION

An object of the invention is to provide a method of simultaneously building and processing two or more streams which consist of or contain a fibrous material and from which the surplus of fibrous material can be removed in a novel and improved way.

Another object of the invention is to provide a novel and improved method of guiding and advancing plural streams of fibrous material preparatory to, during and subsequent to removal of the surplus.

A further object of the invention is to provide a novel and improved apparatus for the practice of the above outlined method and to equip the apparatus with novel and improved means for advancing plural streams toward, past and beyond the surplus removing means.

An additional object of the invention is to provide a novel and improved apparatus for simultaneously building, guiding and trimming two or more discrete tobacco streams in a rod making machine which turns out cigarettes or other rod-shaped products of the tobacco processing industry.

Still another object of the invention is to provide novel and improved means for guiding the conveyors for discrete streams of fibrous material in the above outlined apparatus.

A further object of the invention is to provide the apparatus with stream guiding means which render it possible to employ conventional trimming or equalizing devices.

An additional object of the invention is to provide the apparatus with novel and improved channels for streams of fibrous material.

SUMMARY OF THE INVENTION

One feature of the present invention resides in the provision of a method of building and manipulating a plurality of streams of fibrous material, particularly tobacco. The method comprises the steps of assembling fibrous material into a plurality of discrete streams each of which contains a surplus of fibrous material, conveying the streams in a predetermined direction along discrete paths, removing the surplus in predetermined portions of the respective paths, and maintaining at least the predetermined portion of each path in spaced-apart position relative to each other path.

The maintaining step can include inclining a second portion of each path upstream of and relative to the respective predetermined portion. Still further, the method can include the step of inclining a third portion of each path downstream of and relative to the respective predetermined portion so that the path portion following the third portion of each path is at least substantially aligned and can be coplanar with the path portion preceding the second portion of each path.

Another feature of the invention resides in the provision of an apparatus for building and manipulating a plurality of streams of fibrous material, particularly tobacco. The apparatus comprises means for assembling fibrous material into a plurality of discrete streams (i.e., at least two discrete streams) each of which contains a surplus of fibrous material, a plurality of conveyors arranged to advance the streams along predetermined paths in a predetermined direction, a plurality of equalizing means including means for removing the surplus in predetermined portions of the respective paths, and means for guiding the conveyors so that each predetermined portion is spaced apart from each other path.

The guiding means can include means for inclining a second portion of each path upstream and relative to the respective predetermined portion.

The equalizing means are or can be disposed one behind the other in the predetermined direction.

Each conveyor can include an endless foraminous conveyor, particularly an endless air-permeable belt conveyor, a channel for each foraminous conveyor, and means for establishing a pressure differential between opposite sides of each foraminous conveyor so that the streams are pneumatically urged against the respective foraminous conveyors. The means for establishing a pressure differential can include suction chambers so that the streams are attracted to the respective foraminous conveyors.

The means for guiding the endless conveyors can include pulleys or sprocket wheels. Alternatively, the guiding means can include grooves provided in the sidewalls of the aforementioned channels and receiving the marginal portions of the respective endless conveyors.

The predetermined portion of each path is or can be substantially horizontal, and the guiding means can be designed to incline second portions of the paths upstream of and relative to the respective predetermined portions, preferably through identical angles. The paths can be disposed at different levels. A further portion of each path can be disposed in a predetermined plane upstream of the respective predetermined portion, and an additional portion of each path can be disposed in such plane downstream of the respective predetermined portion. The guiding means then includes means for diverting the conveyors from the predetermined plane between the further portions and the predetermined portions as well as for diverting the conveyors back into the predetermined plane between the predetermined portions and the additional portions of the respective paths.

As mentioned above, the equalizing means can be disposed one behind the other in the predetermined direction, the paths can be disposed at different levels, and the predetermined portions of the paths can be or are substantially horizontal. The guiding means then includes means for inclining second portions of the paths upstream of and relative to the respective predetermined portions so that the predetermined and second portions of all paths make substantially identical first angles, and the guiding means then preferably further includes means for inclining third portions of the paths downstream of and relative to the respective predetermined portions through second angles which are smaller than the first angles. Each downstream second angle (as seen in the predetermined direction) is smaller than each upstream second angle. All of the angles are or can be relatively or very small acute angles (e.g., in the range of a few degrees).

At least one of the surplus removing means preferably comprises a plurality of coplanar rotary trimming discs.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 1:
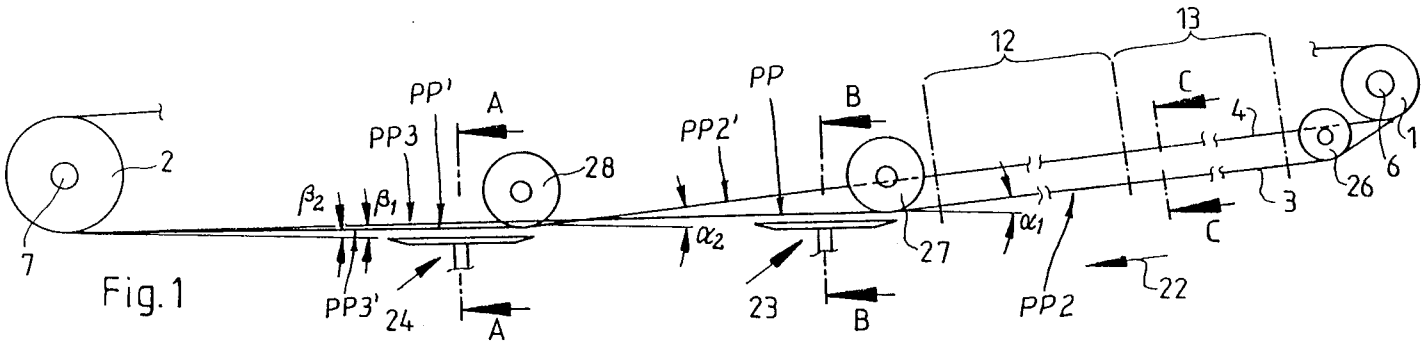
FIG. 1 is a fragmentary schematic side elevational view of an apparatus which embodies one form of the invention and wherein the means for guiding the conveyors for discrete streams of fibrous material includes pulleys.
Figure 4:
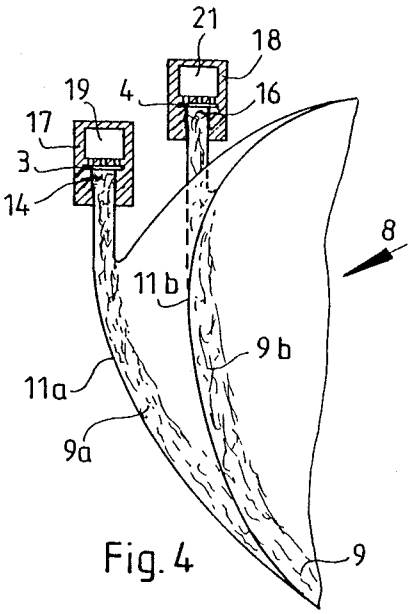
FIG. 4 is an enlarged fragmentary vertical sectional view of a distributor which supplies fibrous material to the conveyors of the apparatus of FIG. 1, the section being taken in the direction of arrows as seen from the line C—C of FIG. 1.

Referring first to FIGS. 1 to 4, there is shown an apparatus which forms part of a rod making machine, particularly a machine for simultaneously producing several cigarette rods. The apparatus includes a distributor 8 (shown in FIG. 4) which serves to assemble fibrous material (such as fragments of natural, reconstituted and/or substitute tobacco) into a single flow 9 which is thereupon subdivided by subdividing means 11*a*, 11*b* into two discrete flows 9*a* and 9*b* advancing from below toward and into two discrete elongated tobacco channels 17, 18. The flow 9*a* is converted into a first stream 14 at the underside of the lower reach of a first endless foraminous belt conveyor 3 which is trained over guiding means including pulleys 1, 26, 27, 2, and the flow 9*b* is converted into a second stream 16 at the underside of the lower reach of a second endless foraminous belt conveyor 4 which is trained over the aforementioned pulleys 1, 2 as well as over an additional pulley 28. The pulleys are shown in FIG. 1.

The conveyors 3, 4 are disposed in two adjacent vertical planes, and the upper sides of their lower reaches are respectively adjacent the perforated bottom walls of two suction chambers 19, 21 which can form integral parts of the respective channels 17, 18 and serve to establish pressure differentials between the upper sides and the undersides of the respective lower reaches so that the streams 14, 16 are pneumatically urged (attracted by suction) to the corresponding conveyors 3 and 4. The lower reaches of the conveyors 3 and 4 define for the respective streams 14, 16 two elongated paths wherein the streams are advanced in the direction of arrow 22. Each of the pulleys 1, 2 can constitute an elongated one-piece roller which is sufficiently long to be surrounded by portions of both conveyors 3, 4. Alternatively, each of these pulleys can comprise two discrete portions which are coaxial with each other and which respectively serve to guide the conveyors 3 and 4. The means for driving the pulley 1 comprises a shaft 6 which is mounted in the frame of the rod making machine. The pulley 2 is mounted on a shaft 7 which is parallel to the shaft 6. The conveyor 3 is located in front of the conveyor 4, as seen in FIG. 1.

The distributor 8 can be of the type disclosed in commonly owned copending U.S. patent application Ser. No. 173,238 filed Mar. 24, 1988 by Siems for "Method of and machine for simultaneously making two or more rods of fibrous material". The disclosure of this copending application is incorporated herein by reference. Similar distributors are described and shown in numerous other United States and foreign patent applications of the assignee of the present application.

Figure 2:
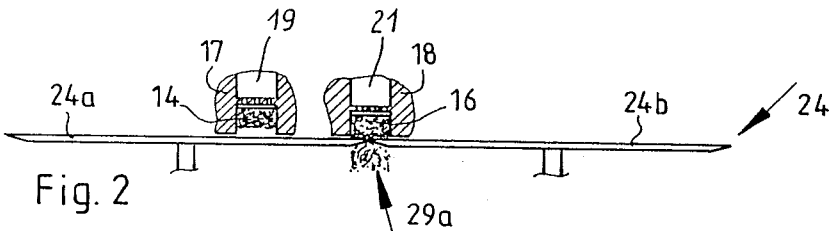
FIG. 2 is an enlarged transverse vertical sectional view of the downstream equalizing device in the apparatus of FIG. 1, substantially as seen in the direction of arrows from the line A—A of FIG. 1.

The stream building zone where the flow 9*a* is converted into the stream 14 at the underside of the lower reach of the conveyor 3 is shown at 12, and the stream building zone where the flow 9*b* is converted into the stream 16 is shown at 13 (reference being had to the right-hand portion of FIG. 1). The stream 14 contains a surplus 29 (FIG. 3), and the stream 16 contains a surplus 29*a* (FIG. 2) of fibrous material. Such surplus is removed by two discrete trimming or equalizing devices 23, 24 which are disposed behind each other in the direction of arrow 22, with the device 24 located downstream of the device 23. The surplus (29) removing means of the equalizing device 23 comprises two rotary coplanar trimming discs 23*a*, 23*b* (FIG. 2), and the surplus (29*a*) removing means of the equalizing device 24 comprises two coplanar rotary trimming discs 24*a*, 24*b* (FIG. 2).

In accordance with a feature of the invention, the guiding means (including the pulleys 1, 2 and 26 to 28) is designed and mounted in such a way that a predetermined portion PP of the path for the stream 14 (namely the portion wherein the stream 14 is relieved of the surplus 29 by the trimming discs 23*a*, 23*b*) is spaced apart from the path for the stream 16, and that a predetermined portion PP' of the path for the stream 16 (namely the portion where the surplus 29*a* is removed by the trimming discs 24*a*, 24*b*) is spaced apart from the path for the stream 16. The portions PP and PP' of the respective paths are or can be substantially horizontal. The pulleys 26, 27 cooperate to incline the path portion PP2 relative to the path portion PP through a small acute angle $\alpha_1$, and the pulleys 27, 2 cooperate to incline the path portion PP3 relative to the path portion PP through a second acute angle, $\beta_l$ which is smaller than the angle $\alpha_1$. The pulleys 27, 2 maintain the trimmed or equalized stream 14 (such trimmed stream constitutes a rod-like filler which is ready to be draped into a web of cigarette paper or the like in a manner not forming part of the present invention) outside of the range of the equalizing device 24.

Figure 3:
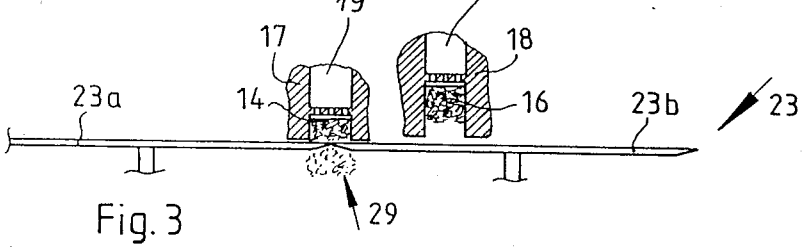
FIG. 3 is an enlarged transverse vertical sectional view of the upstream equalizing device, substantially as seen in the direction of arrows from the line B—B of FIG. 1.

The pulleys 1 and 28 cooperate to incline the path portion PP2' for the stream 16 at an acute angle $\alpha_2$ relative to the path portion PP', and the pulleys 28, 2 cooperate to incline the path portion PP3' for the stream 16 at an acute angle $\beta_2$ relative to the path portion PP'. The angle $\alpha_1$ equals or closely approximates the angle $\alpha_2$, and the (upstream) angle $\beta_1$ is larger than the (downstream) angle $\beta_2$. It will be noted that the paths for the streams 14 and 16 are disposed at different levels (with the sole exception of the region in immediate proximity to the pulley 2). The aforedescribed positioning of the guiding means 1, 2, 26–28 ensures that the stream 16 invariably bypasses the predetermined path portion PP where the discs 23*a*, 23*b* remove the surplus 29 from successive increments of the advancing stream 14, and that the stream 14 invariably bypasses the predetermined path portion PP' where the trimming discs 24*a*, 24*b* remove the surplus 29*a* from successive increments of the stream 16. FIG. 2 shows the removal of surplus 29*a* by the trimming discs 24*a*, 24*b*, and FIG. 3 shows the removal of surplus 29 by the trimming discs 23*a*, 23*b*. The trimming devices 23, 24 can be similar to that which is disclosed in commonly owned U.S. Pat. No. 4,651,755 granted Mar. 24, 1987 (Rudszinat) for "Apparatus for trimming a stream of smokable material".

Figure 5:
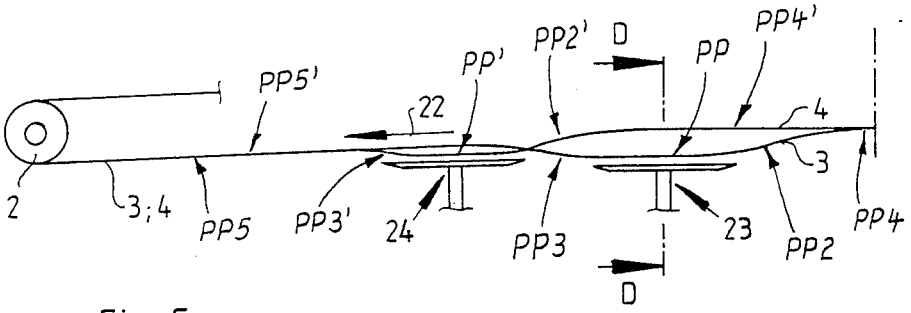
FIG. 5 is a fragmentary schematic side elevational view of a modified apparatus wherein the means for guiding the conveyors includes grooved sidewalls of the tobacco channels.
Figure 6:
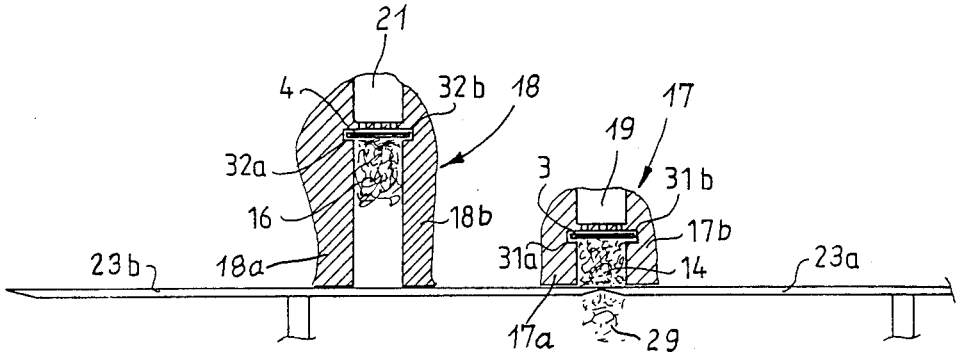
FIG. 6 is an enlarged transverse vertical sectional view as seen in the direction of arrows from the line D—D of FIG. 5.

FIGS. 5 and 6 show certain portions of a modified apparatus wherein the guiding means includes the pulleys 1 and 2 (only the pulley 2 is shown in FIG. 5) and the sidewalls 17*a*, 17*b* and 18*a*, 18*b* of the channels 17, 18. More specifically, the guiding means includes a pair of elongated grooves 31*a*, 31*b* which are machined into or otherwise formed in the inner sides of the sidewalls 17*a*, 17*b* to receive the respective marginal portions of the lower reach of the foraminous belt conveyor 3, and a pair of elongated grooves 32*a*, 32*b* which are machined into or otherwise formed in the inner sides of the sidewalls 18*a*, 18*b* to receive and guide the respective marginal portions of the endless foraminous belt conveyor 4. The manner in which the streams 14 and 16 are formed or built at the undersides of the lower reaches of conveyors 3 and 4 in a region to the right of FIG. 5 is or can be the same as described in connection with FIGS. 1 and 4.

The pulleys 1, 2 cooperate with the grooves 31*a*, 31*b* in such a way that the path for the stream 14 includes a (substantially horizontal) predetermined portion PP in the region where the trimming discs 23*a*, 23*b* of the upstream equalizing device 23 remove the surplus 29 from the stream 14, a second portion PP2 which is located immediately upstream of and is inclined downwardly at an acute angle to the portion PP, a third portion PP3 which is located downstream of and is inclined relative to the portion PP, a fourth portion PP4 which is located upstream of and is inclined relative to the portion PP2, and a fifth portion PP5 which is located downstream of and is inclined relative to the portion PP3. The portions PP4 and PP5 are coplanar, i.e., the grooves 31*a*, 31*b* serve to divert the conveyor 3 from the common plane of the portions PP4, PP5 upstream of the portion PP and to divert the conveyor 3 from the path portion PP back into the common plane of path portions PP4, PP5 downstream of the equalizing device 23. Deflection of the stream 14 from the path portion PP toward the path portion PP5 takes place, or at least begins, upstream of the equalizing device 24.

The path for the stream 16 includes a predetermined portion PP' where the trimming discs of the downstream equalizing device 24 remove the surplus, a second portion PP2' which is inclined relative to and is located upstream of the portion PP', a third portion PP3' which is located downstream of and is inclined relative to the portion PP', a fourth portion PP4' which is inclined relative to and is located upstream of the portion PP2', and a fifth portion PP5' which is located downstream of and is inclined relative to the path portion PP3'. The path portions PP4' and PP5' are coplanar with the path portions PP4, PP5.

FIG. 6 shows the coplanar trimming discs 23*a*, 23*b* of the upstream equalizing device 23 in the process of removing the surplus 29 from the stream 14. At such time, the stream 16 (in the path portion PP4') is located at a level above the path portion PP for the stream 14.

It is within the purview of the invention to select the guiding means in such a way that the entire lower reach of the conveyor 3 (i.e., the entire path for the stream 14) is remote from the lower reach of the conveyor 4 (i.e., from the entire path for the stream 16). The number of streams, and hence the number of conveyors, can be increased to three or more without departing from the spirit of the invention. All that is necessary is to design the guiding means in such a way that at least the predetermined portion of the path for each stream (namely the path portion where the surplus is removed from the respective stream) is spaced apart from each other path so as to ensure unimpeded removal of the surplus by proven highly reliable equalizing devices.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A method of building and manipulating a plurality of streams of fibrous material of the tobacco processing industry, comprising the steps of assembling fibrous material into a plurality of discrete streams each of which contains a surplus of fibrous material; conveying the streams in a predetermined direction along discrete paths; removing the surplus in predetermined portions of the respective paths; and maintaining at least the predetermined portion of each path at a different level.

2. The method of claim 1, wherein said maintaining step includes inclining a second portion of each path upstream of and relative to the respective predetermined portion.

3. The method of claim 2, further comprising the step of inclining a third portion of each path downstream of and relative to the respective predetermined portion so that the path portion following the third portion of each path is at least substantially aligned with the path portion preceding the second portion of each path.

4. Apparatus for building and manipulating a plurality of streams of fibrous material of the tobacco processing industry, comprising means for assembling fibrous material into a plurality of discrete streams each of which contains a surplus of fibrous material; a plurality of conveyors arranged to advance the streams in a predetermined direction along predetermined paths; a plurality of equalizing means including means for removing the surplus in predetermined portions of said paths; and means for guiding said conveyors so that each of said predetermined portions is disposed at a different level.

5. The apparatus of claim 4, wherein said guiding means includes means for inclining a second portion of each path upstream of and relative to the respective predetermined portion.

6. The apparatus of claim 4, wherein said equalizing means are disposed one behind the other in said predetermined direction.

7. The apparatus of claim 4, wherein each of said conveyors includes an endless foraminous conveyor, a channel for each foraminous conveyor, and means for establishing a pressure differential between opposite sides of each foraminous conveyor so that the streams are pneumatically urged against the respective foraminous conveyors.

8. The apparatus of claim 4, wherein said conveyors include endless flexible conveyors and said guiding means includes pulleys or sprocket wheels for said flexible conveyors.

9. The apparatus of claim 4, wherein said conveyors include endless flexible conveyors and further comprising a channel for each of said conveyors, said channels having walls flanking the respective paths and said guiding means including grooves provided in said walls and receiving portions of the respective endless conveyors.

10. The apparatus of claim 4, wherein at least one of said surplus removing means comprises a plurality of coplanar rotary trimming discs.

11. Apparatus for building and manipulating a plurality of streams of fibrous material of the tobacco processing industry, comprising means for assembling fibrous material into a plurality of discrete streams each of which contains a surplus of fibrous material; a plurality of conveyors arranged to advance the streams in a predetermined direction along predetermined paths which are disposed at different levels; a plurality of equalizing means including means for removing the surplus in substantially horizontal predetermined portions of said paths; and means for guiding said conveyors so that each of said predetermined portions is spaced apart from each other path, said guiding means including means for inclining second portions of said paths upstream of and relative to the respective predetermined portions.

12. The apparatus of claim 11, wherein said second portions and the respective predetermined portions of said paths make identical angles.

13. Apparatus for building and manipulating a plurality of streams of fibrous material of the tobacco processing industry, comprising means for assembling fibrous material into a plurality of discrete streams each of which contains a surplus of fibrous material; a plurality of conveyors arranged to advance the streams in a predetermined direction along predetermined paths, each of said conveyors including an endless flexible conveyor and each of said paths including a predetermined portion, a second portion disposed in a predetermined plane upstream of the respective predetermined portion and a third portion disposed in a plane downstream of the respective predetermined portion; a plurality of equalizing means including means for removing the surplus in said predetermined portions of said paths; and means for guiding said conveyors so that each of said predetermined portions is spaced apart from each other path, said guiding means including means for diverting said conveyors from said plane between the second and predetermined portions and for diverting said conveyors back into said plane between the predetermined and third portions of the corresponding paths.

14. Apparatus for building and manipulating a plurality of streams of fibrous material of the tobacco processing industry, comprising means for assembling fibrous material into a plurality of discrete streams each of which contains a surplus of fibrous material; a plurality of conveyors arranged to advance the streams in a predetermined direction along predetermined paths which are disposed at different levels; a plurality of equalizing means including means for removing the surplus in substantially horizontal predetermined portions of said paths, said equalizing means being disposed one behind the other in said direction; and means for guiding said conveyors so that each of said predetermined portions is spaced apart from each other path, said guiding means including means for inclining second portions of said paths upstream of and relative to the respective predetermined portions so that the predetermined and second portions of all paths make substantially identical first angles, said guiding means further including means for inclining third portions of said paths downstream of and relative to the respective predetermined portions through second angles smaller than said first angles.

15. The apparatus of claim 14, wherein each downstream second angle is smaller than each upstream second angle.

16. The apparatus of claim 14, wherein said angles are small acute angles.

* * * * *

UNITED STATES PATENT AND TRADEMARK OFFICE

CERTIFICATE OF CORRECTION

PATENT NO. : 4,924,885

DATED : May 15, 1990

INVENTOR(S) : Uwe HEITMANN et al.

It is certified that error appears in the above-identified patent and that said Letters Patent is hereby corrected as shown below:

Foremost Page - FOREIGN APPLICATION PRIORITY DATA: "Japan" should read --Fed. Rep. of Germany--.

Signed and Sealed this

Twenty-third Day of July, 1991

*Attest:*

HARRY F. MANBECK, JR.

*Attesting Officer*

*Commissioner of Patents and Trademarks*